United States Patent [19]

Rhoton et al.

[11] 3,949,959

[45] Apr. 13, 1976

[54] ANTENNA APPARATUS FOR VEHICLE TRACK RAIL SIGNALS

[75] Inventors: Richard S. Rhoton, Monroeville; David H. Woods, Pittsburgh, both of Pa.

[73] Assignee: Westinghouse Electric Corporation, Pittsburgh, Pa.

[22] Filed: Oct. 17, 1974

[21] Appl. No.: 515,746

[52] U.S. Cl. ..... 246/34 CT; 246/34 R

[51] Int. Cl.[2] ..... B61L 21/08

[58] Field of Search ..... 246/34 R, 34 CT, 36, 112, 246/113, 114 R, 115

[56] References Cited

UNITED STATES PATENTS

| | | | |
|---|---|---|---|
| 3,582,644 | 6/1971 | Schatzel | 246/34 CT |
| 3,794,833 | 2/1974 | Blazek | 246/34 CT |
| 3,821,544 | 6/1974 | Matty | 246/34 CT |

*Primary Examiner*—Trygve M. Blix
*Assistant Examiner*—Reinhard J. Eisenzopf
*Attorney, Agent, or Firm*—R. G. Brodahl

[57] ABSTRACT

An antenna apparatus is disclosed for coupling audio frequency signals in relation to one or more vehicle track rails of a transit system for the purpose of determining vehicle occupancy of a given signal block and providing speed coded control signals to a vehicle moving along the track rail in that given signal block. It is desired that each signal block in the transit system track circuit operate with the signal level above a predetermined minimum signal level for reasons of vehicle occupational detection. The antenna apparatus is operative to enable desired adjustment of the signal level in a given signal block and in adjacent signal blocks relative to that given signal block.

6 Claims, 5 Drawing Figures

ANTENNA APPARATUS FOR VEHICLE TRACK RAIL SIGNALS

CROSS-REFERENCE TO RELATED APPLICATION

The present application is related to a concurrently filed application Ser. No. 515,747 filed Oct. 7, 1974 by R. H. Perry et al entitled "Antenna Apparatus For Vehicle Track Rail Signals" and assigned to the same assignee as the present application.

BACKGROUND OF THE INVENTION

It is known in the prior art to control the movement of a train vehicle passing through a fixed block track circuit signalling system including specific signal blocks which are established by predetermined low impedance electrical signal boundaries at the ends of each signal block. When a train is present in a given signal block at least one vehicle axle and associated wheels of the train electrically shorts between the two conductive track rails on which the wheels run. A signal transmitter operates at one end of each signal block and a cooperative signal receiver is coupled to the track at the opposite end of that signal block for providing desired occupancy sensing and control of the train vehicle movement within that signal block. A train vehicle control signal system of this general type is described in U.S. Pat. No. 27,472 of G. M. Thorne-Booth, U.S. Pat. Nos. 3,593,022 and 3,746,857 both of R. C. Hoyler et al.

The low impedance shunt boundary connections 14, 18 and 20 do not provide the desired isolation required for track signalling circuits and therefore the well known problems of pre-detection, post-detection and signal leakage are presented. In addition, for track circuits without insulated joints the injected track signals propagate in both directions in relation to the shunt boundary member 14. Many of these problems can be minimized by normalizing the signal currents within the respective signal blocks N and N+1 such that the signal level within each of the signal blocks N and N+1 is above a predetermined signal level and substantially equal.

It is known in the prior art to inject signal currents into track rails by direct injection of a voltage directly across the track rails, by inductive injection through transformer action of signal currents utilizing the low impedance shunt boundary member 14, and by inductive injection into the track rail itself through operation of a loop antenna. It is difficult to balance the signal levels in respectively adjacent signal blocks in relation to both direct injection of signal voltages directly across the track rails and inductive injection through transformer action of signal currents in relation to the low impedance shunt member 14. This is particularly true for signal blocks having different impedance characteristics such as would be provided by different block lengths. If the signal block N is approximately 150 meters or 500 feet long and the signal block N+1 is approximately 300 meters or 1,000 feet long, it is likely that the signal block N would have twice the signal current level as compared to the signal block N+1 solely because of the difference in the respective lengths and related impedance characteristics of the signal blocks. The inductive loop injection approach for the introduction of signal current into a track rail through operation of a loop antenna is operative such that by shifting the position of the loop antenna, the signal current level within the respective signal blocks N and N+1 can be balanced or normalized in relation to the signal voltage sources induced in the track rails. However, the inductive signal current injection by operation of a loop antenna has two disadvantages which cause concern in a high performance and failsafe train control system, (1) the antenna loop, because of its characteristic magnetic field, can have a signal cross-talk problem in relation to the induction of undesired signal currents in adjacent track rails, and (2) the antenna loop, because of the voltage induced in the track rails, has a reflection problem in relation to a long and short track circuit configuration. The signal cross-talk problem can be improved by using a flat plate antenna replacement for the loop antenna arrangement, as the magnetic field for a flat plate antenna is oriented differently, however, the signal reflection problem is not improved in this manner.

SUMMARY OF THE INVENTION

The antenna apparatus of the present invention is operative to directly inject a desired signal into each of adjacent signal blocks operative with a common boundary connection member and to inductively inject that same signal into each of those signal blocks, such that a desired balance or normalizing of the respective signal levels can be effected in relation to any different signal block impedance characteristics that may be involved.

DESCRIPTION OF THE PREFERRED EMBODIMENT

Figure 1:
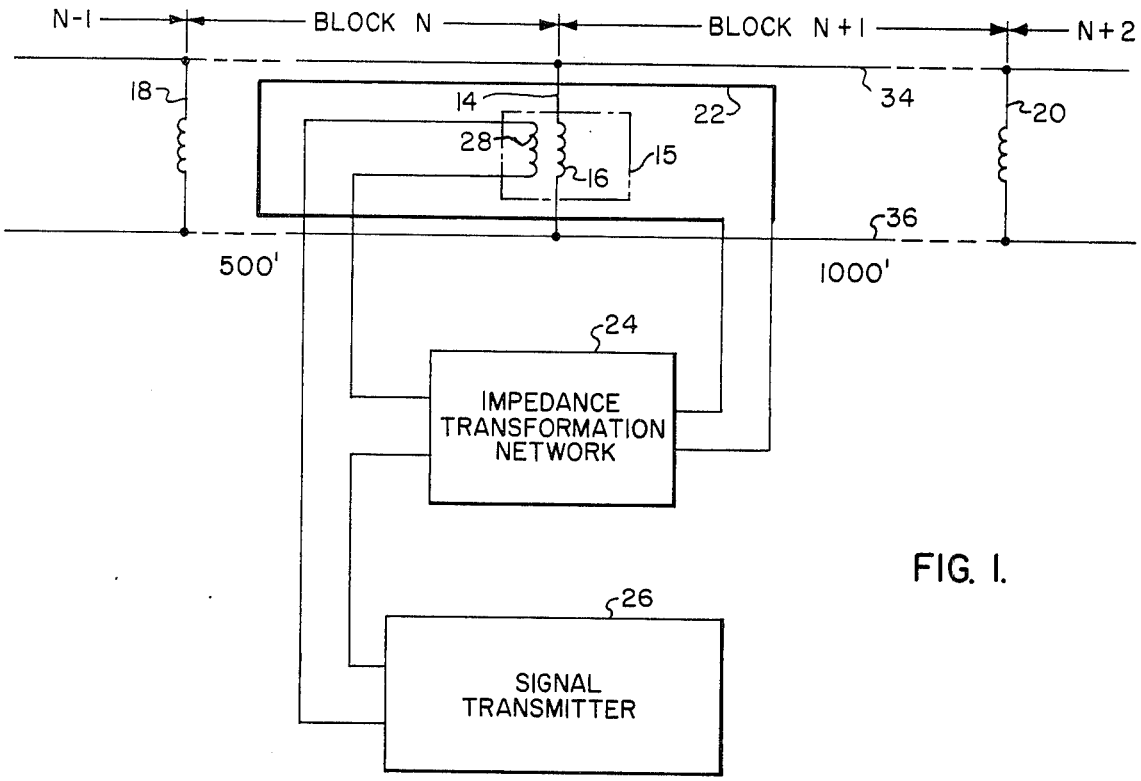
FIG. 1 is a schematic showing of the present antenna apparatus for providing both a direct injection of a signal voltage and an inductive injection of a signal voltage into the vehicle track rails.

In FIG. 1 there is shown a vehicle track system including a signal block N and an adjacent signal block N+1 separated by a low impedance shunt boundary member 14 having one of a characteristic inductance or an inserted secondary winding indicated by the inductor 16. The block N at its opposite end has a low impedance shunt boundary member 18 and the block N+1 at its opposite end has a low impedance shunt boundary member 20. The injection of suitable signals into signal blocks N and N+1 is necessary for determination of vehicle occupancy within each of the signal blocks and in addition it is desired to provide speed coded control signals to a vehicle passing through each of the signal blocks.

A loop antenna 22 is shown operative with an impedance transformation network 24 in relation to signal currents received from a signal transmitter 26. A transformer primary winding 28 is operative with the inductance 16 of the low impedance shunt boundary member 14, for the purpose of direct injection of signal currents in each of the signal blocks N and N+1, and the loop antenna 22 is operative to provide inductive injection of signal currents from the signal transmitter 26 into the signal blocks N and N+1. The impedance transformation network 24 can be adjusted such that the coupling between the primary winding 28 and the boundary member 14 injects the majority of signal current into each of the signal blocks N and N+1 while the loop antenna 22 is used to balance any resulting offset currents. For example, if it is desired to normalize each of the signal blocks N and N+1 to a signal level of 100 milliamps, the primary winding 28 operative with the boundary member 14 could provide up to 132 milliamps of signal current in the signal block N and in the order of 66 milliamps of signal current in the signal block N+1. By suitable adjustment of the physical position of the loop antenna in relation to the boundary member 14, this is assuming an illustrative situation where the signal block N is approximately 150 meters or 500 feet in length and the signal block N+1 is approximately 300 meters or 1,000 feet in length and the input impedance of the signal block N is one half the input impedance of the signal block N+1, the signal level in each of the track circuit signal blocks N and N+1 can be balanced to approximately 100 milliamps. The impedance transformation network 24 is utilized to match the impedances of the loop antenna 22 in relation to the effective impedance of the direct injection antenna 15 including the primary winding 28. Depending upon the relative impedances of the loop antenna 22 as compared to the direct injection antenna 15, the loop antenna need not be physically centered in relation to the boundary member 14. There will be a physical position of the loop antenna 22 and a resulting impedance ratio relationship which gives the most efficient signal injection into the respective signal blocks N and N+1.

The advantages of the antenna apparatus as shown in FIG. 1 are an increased signal injection efficiency and capability, with an opportunity for balancing the signal levels in the respective signal blocks N and N+1, a reduced signal cross-talk problem which may be in the order of a 60% or better reduction and a reduced short track circuit signal block signal reflection which may be in the order of 60% or better.

The signal that goes into the signal blocks N and N+1 from the signal transmitter 26 is used to determine the vehicle occupancy in one or both of the signal blocks N and N+1 as desired and to provide speed code signal communication to determine the operating speed of a vehicle moving within one of the signal blocks N and N+1. When the signal is injected into the boundary member 14 between the signal block N and the signal block N+1, the injected signal goes in both directions away from the boundary member 14 into each of the signal blocks. If a vehicle enters the signal block N from a previous signal block N−1, the train vehicle looks at the level of the signal in the signal block N. On the other hand, if a vehicle enters signal block N+1 from a previous signal block N+2, should the train be moving in a direction from the right to the left as shown in FIG. 1, the train vehicle looks at the signal level in signal block N+1. Operating conditions require that these two signal levels be of approximately the same amplitude, relating to problems of signal cross-talk, signal leakage and threshold conditions on the vehicle and so forth. The speed control signal goes in both directions from a given boundary member 14, since the train vehicle might run in either one of opposite directions through the signal blocks N and N+1.

It is desired that the signal currents in the respective signal blocks N and N+1 should be maintained at about the same magnitude level. If only the loop antenna 22 is utilized, the induced signal voltages in each signal block N and N+1 can be balanced by adjusting the physical position of the loop antenna 22 in relation to the boundary member 14 and no voltage or relatively little voltage will be induced in the shunt boundary member 14 connected between the track rails 34 and 36. The loop antenna 22 has a substantial mutual inductance to each of the track rails 34 and 36 and little mutual inductance to the shunt boundary member 14, such that current in the loop 22 will induce a voltage in each of the track rails 34 and 36. With a single loop antenna 22 each track rail 34 and 36 has small voltage sources induced therein and this sets up signal current in the rail. This has the advantage that the position of the loop antenna 22 can be shifted in relation to the boundary member 14 to in effect balance and make substantially the same the respective induced signal current levels in the two signal blocks N and N+1 operative with the loop antenna 22. In this way a compensation can be made for any difference in the respective impedance characteristics, such as caused by different lengths of the signal block track circuits N and N+1.

If the direct injection coupling arrangement, including the antenna 15 having a primary winding 28 operative with the inductance 16 of the boundary member 14 is used to inject signal current in the track rails 34 and 36, this is effective to provide substantially no voltage sources in the track rails 34 and 36 and substantially all the voltage sources in the shunt member 14. A transformer arrangement as shown can be used for this purpose or capacitive coupling and so forth. The shunt boundary member 14 may be a bar of conductive material such as copper but it has inherent inductance or a secondary winding as indicated at 16 in FIG. 1. The voltage source is induced in the boundary member 14 and the inductance 16 can operate as the transformer secondary included as part of the boundary shunt connection 14. This has the problem that there is no way to balance the resulting signal currents in the associated signal blocks N and N+1 since the common voltage source induced into the boundary member 14 drives into signal blocks having different impedance characteristics. Each signal block current depends upon the voltage and its own signal block impedance. It is not practical to include a balancing impedance in a track rail of one signal block for the purpose of balancing the signal currents within the signal blocks N and N+1.

The direct injection method illustrated by the transformer 15 is very efficient and is small whereas the loop antenna 22 is less efficient and has some signal cross-talk problems since the loop antenna 22 has a large magnetic field that couples to the opposite direction parallel track and induces signal voltage in that parallel track that may cause various safety problems. If the desired signal current in each of signal block N and the signal block N+1 is normalized to 100 units for a typical signal block length of 150 meters or 500 feet, an induced signal level of 50% can occur in the adjacent parallel track if the track circuit in the adjacent parallel track has a low impedance such as would occur for a short length signal block. For example, the track ballast can result in a low leakage resistance from rail to rail in the parallel track and result in a corresponding low impedance characteristic. Thus a train vehicle operating on this adjacent parallel track might receive a speed signal due to cross-talk problems, since for safety purposes the typical vehicle carried signal receiver operation normally responds down to about a 10% signal level.

In a transit system track rails of primary interest for a particular direction of train movement, it is not practical to set for each of a thousand or more signal blocks in that transit system a signal level of 100%, so a practical range of between 80% and 100% is usually obtained in actual practice in relation to a predetermined and desired signal level for providing desired signal receiver operation. The signal level setting is accomplished by shifting the position of the loop antenna 22 in relation to the shunt boundary member 14. Various tolerances are present in the system, such as the ballast resistance may drop the signal level by the time it reaches a location near the opposite end of the signal block to only a 70% level and the receiver carried by a train entering the signal block at the end away from the transmitter must be albe to safely respond to the speed code signal in that signal block. The vehicle has various tolerances requiring an operating margin and this may drop the desired signal level down to about 50%.

The present invention combines the greater efficiency of direct signal injection with the signal level balancing ability of the inductive loop. This is done by going directly into the rails by transformer action or by direct coupling across the shunt boundary member 14 as illustrated by the antenna 15. To provide the desired signal level balancing, the loop antenna 22 is cooperative with the direct signal injection antenna 15 such that the loop antenna 22 can be shifted relative to the shunt member 14 for the purpose of balancing. If 100 units of current are desired in each track circuit signal block N and N+1 associated with the shunt boundary member 14, the direct signal injection by transformer action resulting from the transformer 15 might account for 70 units of signal current and the loop antenna could provide the other 30 units of signal current. If the signal block N+1 is approximately 300 meters or 1,000 feet long and the signal block N is approximately 150 meters or 500 feet long, the direct antenna 15 might provide 130 units of signal current in signal block N and 65 units of signal current in signal block N+1. The loop antenna 22 would then be shifted in position to add 35 units into signal block N+1 and subtract 35 units from signal block N thereby effecting a desired signal level balance in each of the signal blocks N and N+1.

Figure 2:
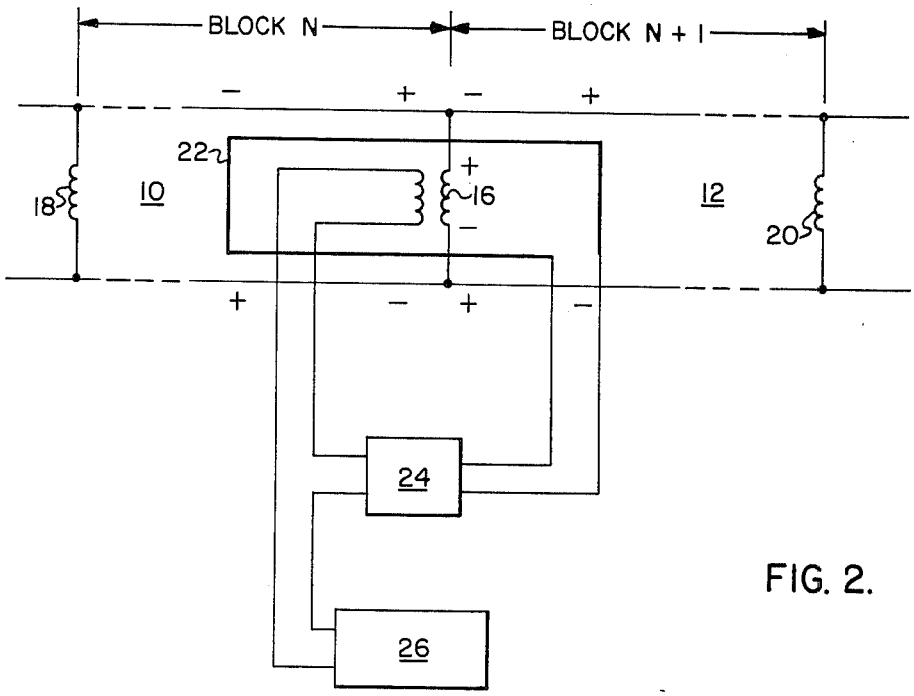
FIG. 2 is a diagrammatic illustration of typical involved signal polarities of the present antenna apparatus.

If the polarity of the direct coupled signal is positive at the top of inductance 16 as shown in FIG. 2, and the polarity of the loop antenna induced signal would be as shown in FIG. 2, then the net signal current in signal block N would result from a difference operation and the net signal current in signal block N+1 would result from an addition operation.

Figure 3:
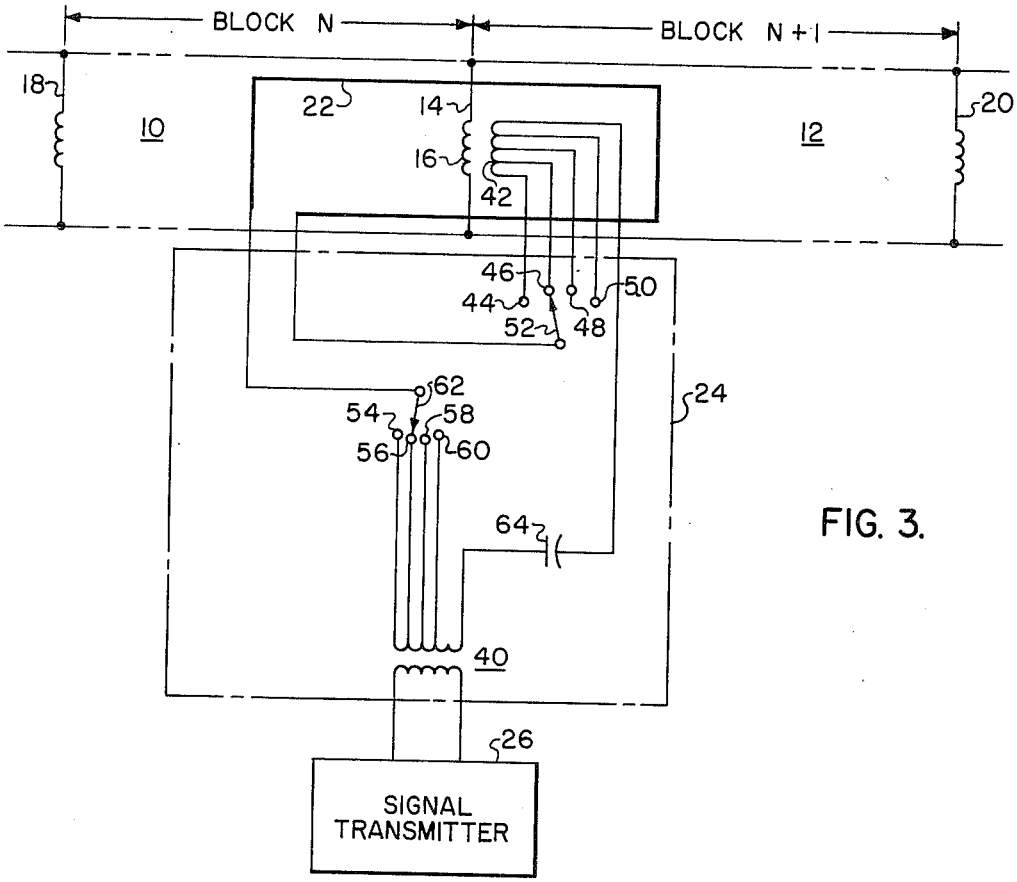
FIG. 3 is a schematic showing of one suitable embodiment of the impedance transformation network.

The impedance transformation network 24 is a coupling apparatus to scale the signal levels as desired in the respective signal blocks N and N+1. It could be as simple as an adjustable resistor in one of the antenna circuits or it could utilize tapped output transformers to provide the desired various signal levels. For example, there is shown in FIG. 3 an arrangement whereby a tapped output transformer 40 is operative with the signal transmitter 26. The transformer primary 42 operative with the inherent inductance 16 of the boundary member 14 is provided with taps 44, 46, 48 and 50, such that the adjustable contactor 52 can be moved to connect with one of the tap contacts 44, 46, 48 and 50 to adjust the effective direct injected signal level in each of the signal blocks N and N+1 by the primary winding 42. In a similar manner, the transformer 40 is provided with tap contacts 54, 56, 58 and 60 operative with an adjustable contactor member 62 such that the output power provided by the transformer 40 can be adjusted as desired. With the antenna arrangement shown in FIG. 3, the loop antenna 22 is connected in series with the direct injection primary winding 42 such that a more failsafe operative signal antenna apparatus arrangement is thereby provided. The tuning capacitor 64 may or may not be required to balance the inductive reactance, to enable the coupling of additional current into the track rails for a given voltage.

Figure 4:
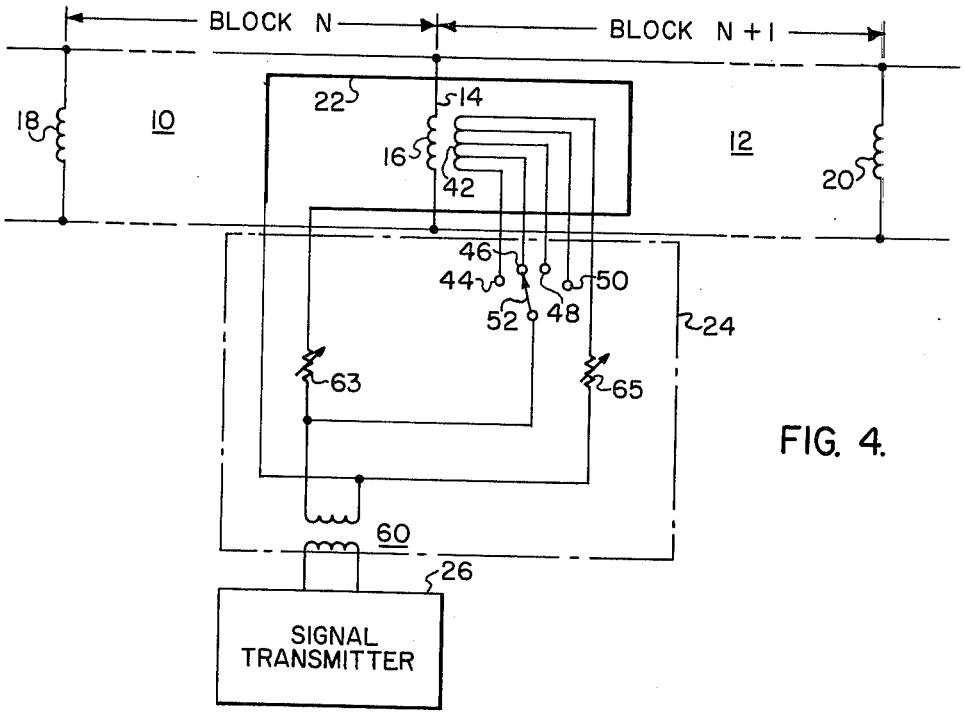
FIG. 4 is a schematic showing of a different embodiment of the impedance transformation network.

In FIG. 4, there is shown a further modification of the present antenna apparatus wherein the signal transmitter 26 is operative through with the loop antenna 22 being connected through an adjustable impedance member 62 across the output winding of the power transformer 60 and is operative with the direct injection primary winding 42 connected across the output winding of the power transformer 60 through an adjustable impedance member 64. The antenna apparatus arrangement shown in FIG. 4 is a parallel driven arrangement with each antenna having an adjustable impedance member for determining the signal level injected by that respective antenna member.

Figure 5:
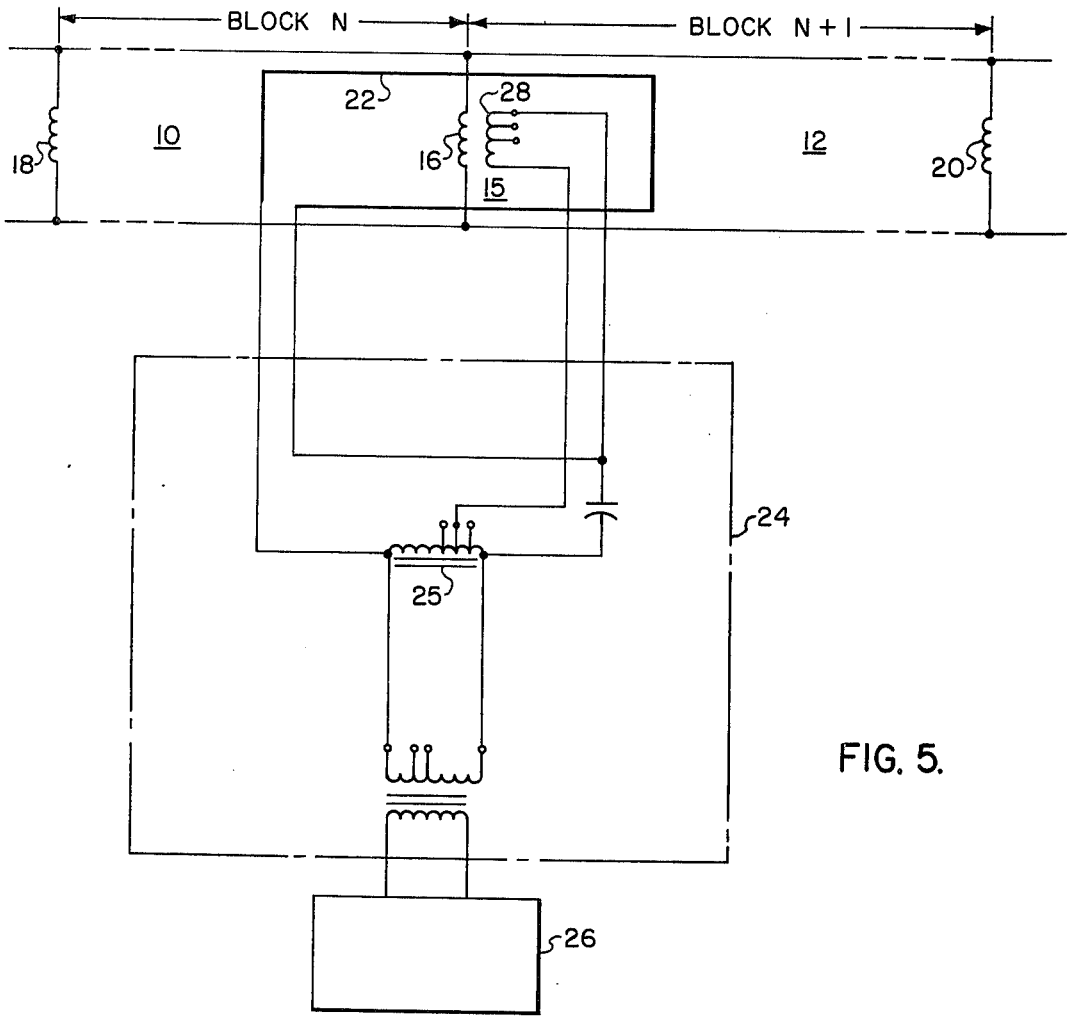
FIG. 5 is a schematic showing of an additional embodiment of the present antenna apparatus.

In FIG. 5, there is shown an illustration of an additional embodiment of the present invention. The impedance transformation network 24 includes an auto transformer 25 having taps that can be selected to vary the voltage applied to either the direct injection antenna 15 or the magnetic coupled antenna 22. The circuit arrangement shown in FIG. 5 is such that a higher voltage is applied to the antenna 22 for a situation where the signal blocks N and N+1 do not have equal impedance characteristics and it is desired that the antenna 22 be utilized for signal level balancing and a lower voltage is applied to the antenna 15. However, if the signal blocks N and N+1 have more equal impedance characteristics, it may be desired to apply a higher voltage to the more efficient antenna 15 such that the larger portion of signal power in the signal blocks N and N+1 is provided by the antenna 15 and a lower voltage is applied by the auto transformer 25 to the antenna 22.

What we claim is:

1. In an antenna apparatus for providing a signal current in a track circuit including a plurality of signal blocks for the control of a vehicle operative with said track circuit, the combination of first means operative with each of adjacent signal blocks for providing a first portion of said signal current in each of said adjacent signal blocks, and second means operative with each of said adjacent signal blocks for providing a second portion of said signal current in each of said adjacent signal blocks, with said first means being more efficient in relation to the provision of signal current in said adjacent signal blocks and said second means being operative to balance the respective signal current levels in said adjacent signal blocks.

2. The antenna apparatus of claim 1 operative with adjacent signal blocks having respectively different input impedances, with said second means being operative to provide said second portion of signal current in each of said adjacent signal blocks to substantially balance the resulting signal current in each of said adjacent signal blocks.

3. The antenna apparatus of claim 1, including means operative with at least one of said first means and said second means for establishing at least a predetermined minimum signal level relationship between said first portion and said second portion of said signal current in each of said adjacent signal blocks.

4. The antenna apparatus of claim 3, with said relationship establishing means being operative to determine a drive voltage for at least said one of said first means and said second means to establish at least said predetermined minimum signal level relationship.

5. The antenna apparatus of claim 1, with said first means being operative with a fixed coupling to each of said adjacent signal blocks and said second means being operative with a variable coupling to each of said adjacent signal blocks.

6. The antenna apparatus of claim 1, with said first means providing direct injection of said first portion of signal current in each of said adjacent signal blocks and said second means providing induced injection of said second portion of signal current in each of said adjacent signal blocks.

* * * * *